US010028640B2

(12) United States Patent
McGrath

(10) Patent No.: US 10,028,640 B2
(45) Date of Patent: Jul. 24, 2018

(54) CLEANING GLOVE DEVICE

(71) Applicant: Charlotte McGrath, Carona Del Mar, CA (US)

(72) Inventor: Charlotte McGrath, Carona Del Mar, CA (US)

( * ) Notice: Subject to any disclaimer, the term of this patent is extended or adjusted under 35 U.S.C. 154(b) by 7 days.

(21) Appl. No.: 15/390,339

(22) Filed: Dec. 23, 2016

(65) Prior Publication Data

US 2017/0105600 A1 Apr. 20, 2017

Related U.S. Application Data

(63) Continuation-in-part of application No. 14/551,822, filed on Nov. 24, 2014.

(51) Int. Cl.

| | |
|---|---|
| ***A47L 25/00*** | (2006.01) |
| ***A47L 13/18*** | (2006.01) |
| ***A41D 19/00*** | (2006.01) |
| ***A43B 3/00*** | (2006.01) |

(52) U.S. Cl.

CPC ..... *A47L 25/005* (2013.01); *A41D 19/0006* (2013.01); *A43B 3/0036* (2013.01); *A47L 13/18* (2013.01); *A41D 2400/52* (2013.01); *A41D 2600/20* (2013.01)

(58) Field of Classification Search

CPC ..... A47L 25/005; A47L 13/18; A41D 19/006; A43B 3/0036

See application file for complete search history.

(56) References Cited

U.S. PATENT DOCUMENTS

| | | | |
|---|---|---|---|
| 3,056,154 | A | 10/1962 | Neal |
| 3,362,775 | A | 1/1968 | Muecke |
| D256,183 | S | 8/1980 | Kupperman et al. |
| 4,811,444 | A | 3/1989 | Hamblin |
| 5,644,813 | A | 7/1997 | Puskas |
| 6,024,970 | A | 2/2000 | Woodard |
| 6,425,136 | B1 | 7/2002 | Schlamp et al. |
| D512,816 | S | 12/2005 | Hall |
| 2009/0113646 | A1 | 5/2009 | Rossell |

*Primary Examiner* — Shay Karls

(57) ABSTRACT

A cleaning glove device includes a cleaning glove having a planar face. The planar face has a palm portion and digit portions extending from the palm portion. A peripheral wall of the cleaning glove extends from a peripheral edge of the planar face. A taper portion of the peripheral wall extends between a main portion and the peripheral edge. The main portion is perpendicular to the planar face. An adhesive layer covers the planar face to have debris adhered to the planar face by the adhesive layer when the cleaning glove is pressed against and removed from a surface.

12 Claims, 3 Drawing Sheets

CLEANING GLOVE DEVICE

CROSS-REFERENCE TO RELATED APPLICATIONS

This application is a continuation in part of application Ser. No. 14/551,822 filed Nov. 24, 2014, abandoned as of Dec. 26, 2016.

BACKGROUND OF THE DISCLOSURE

Field of the Disclosure

The disclosure relates to cleaning devices and more particularly pertains to a new cleaning device for cleaning a surface.

SUMMARY OF THE DISCLOSURE

An embodiment of the disclosure meets the needs presented above by generally comprising a cleaning glove having a planar face. The planar face has a palm portion and digit portions extending from the palm portion. A peripheral wall of the cleaning glove extends from a peripheral edge of the planar face. A taper portion of the peripheral wall extends between a main portion and the peripheral edge. The main portion is perpendicular to the planar face. An adhesive layer covers the planar face to have debris adhered to the planar face by the adhesive layer when the cleaning glove is pressed against and removed from a surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
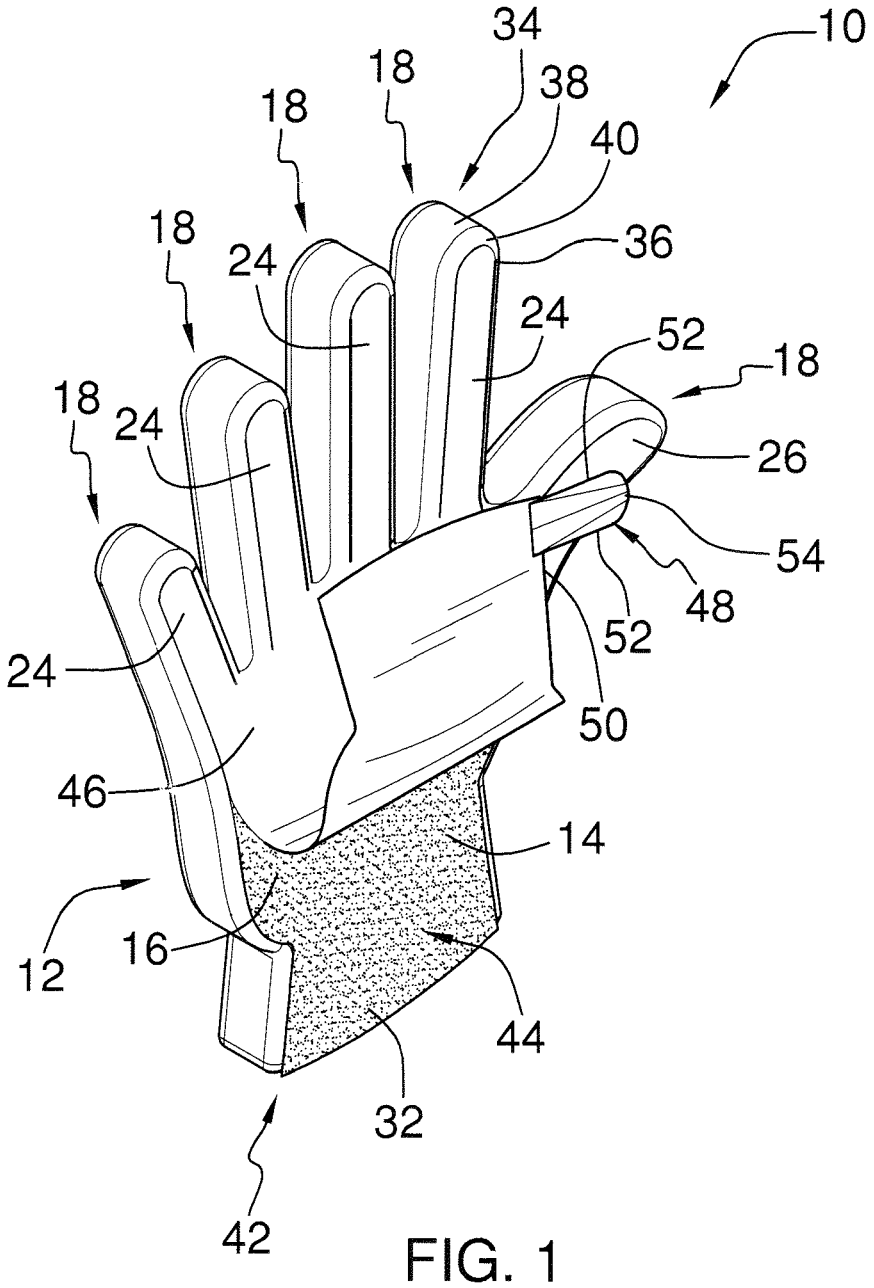
FIG. 1 is a top front side perspective view of a cleaning glove device according to an embodiment of the disclosure.
Figure 2:
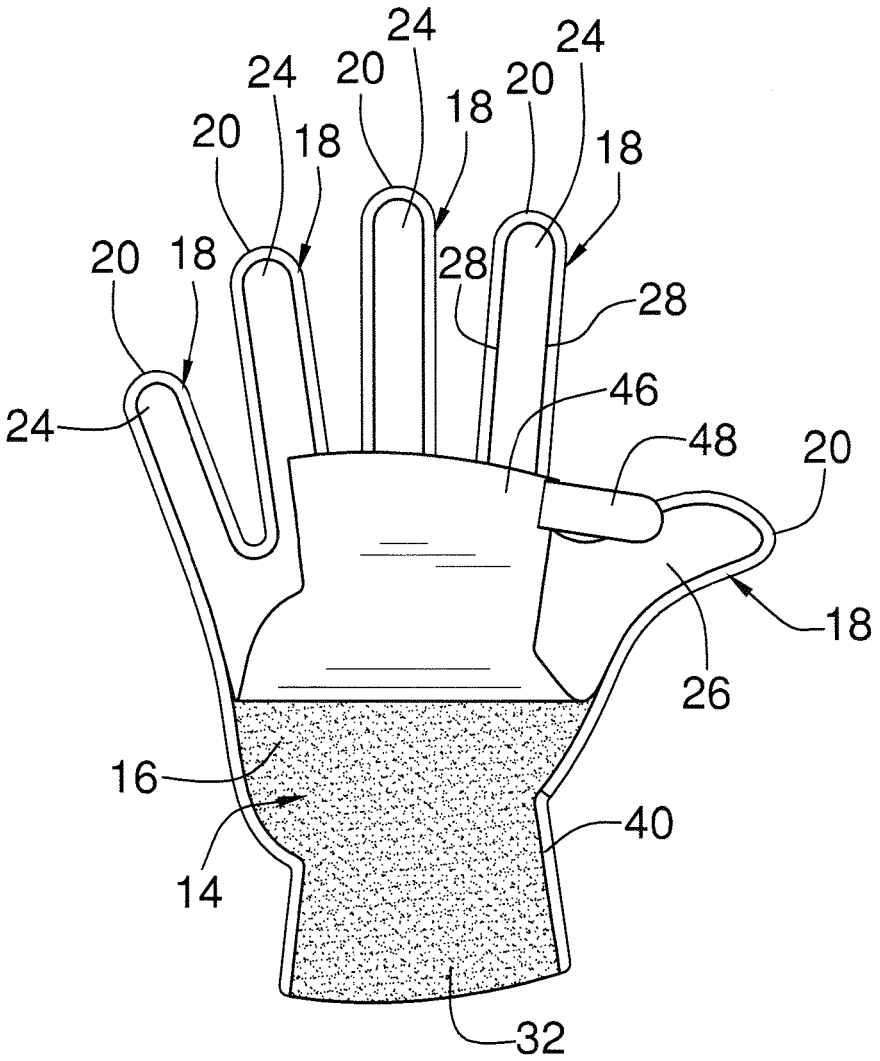
FIG. 2 is a front view of a cleaning glove of an embodiment of the disclosure, a back view being a mirror image thereof.
Figure 3:
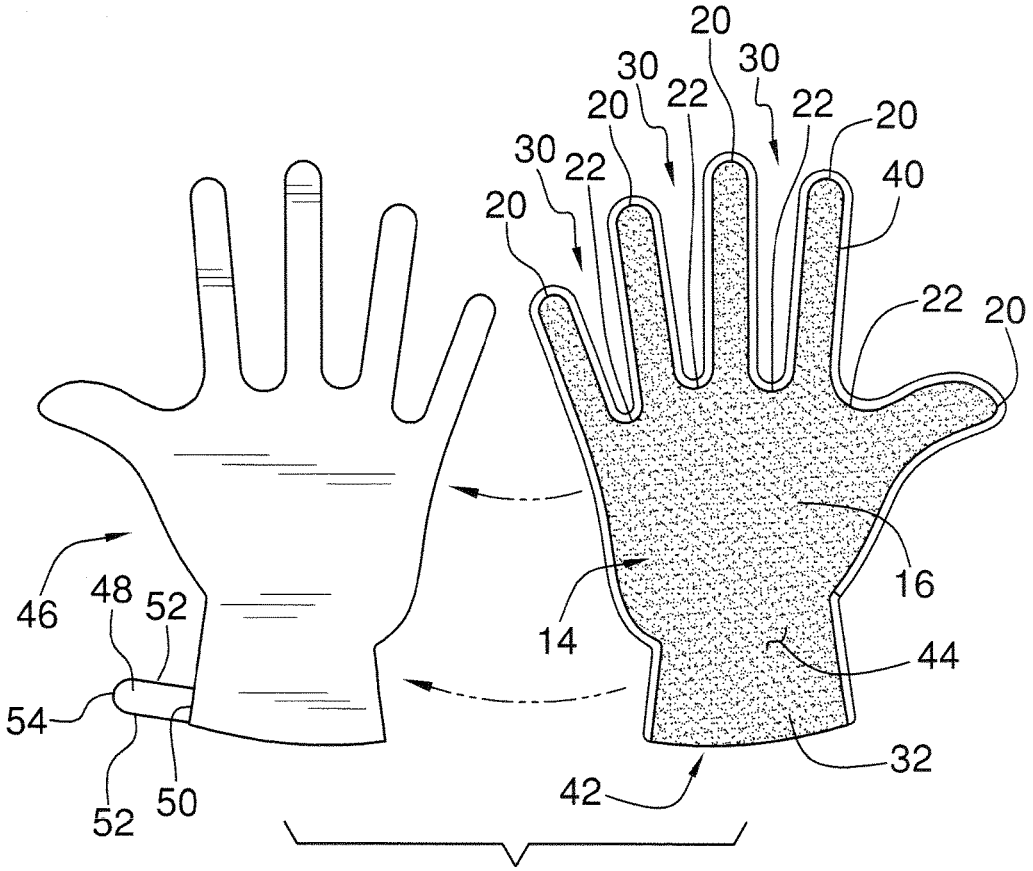
FIG. 3 is a front perspective view of an embodiment of the disclosure.

With reference now to the drawings, and in particular to FIGS. 1 through 3 thereof, a new cleaning device embodying the principles and concepts of an embodiment of the disclosure and generally designated by the reference numeral 10 will be described.

As best illustrated in FIGS. 1 through 3, the cleaning glove device 10 generally comprises a cleaning glove 12 having a planar face 14. The planar face 14 includes a palm portion 16 and a plurality of digit portions 18 coupled to and extending away from the palm portion 16. A respective distal end 20 of each digit portion 18 relative to the palm portion 16 is convexly rounded. Each of a plurality of junctions 22 between the digit portions 18 is concavely arcuate relative to the palm portion 16. The digit portions 18 include a plurality of finger portions 24 and a thumb portion 26. Each of the finger portions 24 extends substantially upwardly away from the palm portion 16 and the thumb portion 26 extends generally laterally away from the palm portion 16 such that the planar face 14 is generally hand-shaped. Each of the finger portions 24 has a pair of longitudinal straight sides 28. The pair of longitudinal straight sides 28 of each finger portion 24 is parallel for that finger portion 24. The finger portions 24 are arranged with a slight fanning between finger portions 24 such that a gap 30 between adjacently positioned finger portions 24 tapers extending from the distal ends 20 towards the junction 22. The planar face 14 also has a wrist portion 32. The wrist portion 32 is coupled to and extends from the palm portion 16 opposite the digit portions 18.

The cleaning glove 12 includes a peripheral wall 34 coupled to and extending from a peripheral edge 36 of the planar face 14. The peripheral wall 34 has a main portion 38 and a taper portion 40. The taper portion 40 extends between the main portion 38 and the peripheral edge 36 of the planar face 14. The main portion 38 is perpendicular to the planar face 14. The cleaning glove 12 has a bottom end 42 which is open wherein the cleaning glove 12 is configured for receiving a hand into the cleaning glove 12 through the bottom end 42.

An adhesive layer 44 is positioned on and covers the planar face 14 wherein the cleaning glove 12 is configured to have debris adhered to the planar face 14 by the adhesive layer 44 when the cleaning glove 12 is pressed against and removed from a surface. The adhesive layer 44 completely covers the planar face 14. A cover 46 is planar and removably positioned on and covers the adhesive layer 44. A tab 48 is coupled to an interiorly facing surface 56 of the cover 46 which abuts the adhesive layer 44. The tab 48 extends outwardly from the cover 46 substantially perpendicular to the peripheral wall 34. Thus, the tab 48 is configured to facilitate being grasped for removal of the cover 46 to expose the adhesive layer 44. The tab 48 extends from an edge 50 of the cover 46 such that the tab 48 is parallel with the cover 46. The tab 48 is elongated having parallel opposite edges 52 and a convexly arcuate end section 54. The tab 48 is positioned adjacent to the thumb portion 26 of the planar face 14.

The cleaning glove 12 may be symmetrical about a plane extending through the main portion 40 of the peripheral wall 34 parallel to the planar face 14 allowing respective adhesive layers on each side of the cleaning glove 12 and orientation for use on either hand depending on which adhesive layer is exposed. Alternatively, one cleaning glove 12 may be used sequentially on one and then the other of a left hand and a right hand exposing the corresponding adhesive layer 44 as needed for use with each hand.

In use, the cleaning glove 12 is worn on a selected hand and the adhesive layer 44 exposed. The cleaning glove 12 is then used to remove debris by pressing the planar face 14 against a surface to be cleaned. The cleaning glove 12 is disposable after use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cleaning glove device configured to remove debris from a surface, said device comprising:

a cleaning glove having a planar face, said planar face including a palm portion and a plurality of digit portions coupled to and extending away from said palm portion, said cleaning glove including a peripheral wall coupled to and extending from a peripheral edge of said planar face, said peripheral wall having a main portion and a taper portion, said taper portion extending between said main portion and said peripheral edge of said planar face, said main portion being perpendicular to said planar face; and an adhesive layer positioned on and covering said planar face wherein said cleaning glove is configured to have debris adhered to said planar face by said adhesive layer when said cleaning glove is pressed against and removed from a surface.

2. The device according to claim 1, further comprising said cleaning glove having a bottom end being open wherein said cleaning glove is configured for receiving a hand into said cleaning glove through said bottom end.

3. The device according to claim 2, further comprising said adhesive layer completely covering said planar face.

4. The device according to claim 1, further comprising a cover, said cover being planar and removably positioned on and covering said adhesive layer.

5. The device according to claim 4, further comprising a tab being coupled to and extending outwardly from said cover substantially perpendicular to said peripheral wall wherein said tab is configured to facilitate being grasped for removal of said cover to expose said adhesive layer.

6. The device according to claim 5, further comprising said tab extending from an edge of said cover wherein said tab is coplanar with said cover.

7. The device according to claim 1, further comprising said planar face having a wrist portion, said wrist portion being coupled to and extending from said palm portion opposite said digit portions.

8. The device according to claim 1, further comprising a respective distal end of each said digit portion relative to said palm portion being convexly rounded.

9. The device according to claim 8, further comprising a plurality of junctions between said digit portions, each of said junctions being concavely arcuate relative to said palm portion.

10. The device according to claim 1, further comprising said digit portions including a plurality of finger portions and a thumb portion, each of said finger portions extending substantially upwardly away from said palm portion and said thumb portion extending generally laterally away from said palm portion.

11. The device according to claim 10, further comprising each of said finger portions having a pair of longitudinal straight sides, said pair of longitudinal straight sides of each finger portion being parallel.

12. A cleaning glove device configured to remove debris from a surface, said device comprising:

a cleaning glove having a planar face, said planar face including a palm portion and a plurality of digit portions coupled to and extending away from said palm portion, a respective distal end of each said digit portion relative to said palm portion being convexly rounded, a plurality of junctions between said digit portions, each of said junctions being concavely arcuate relative to said palm portion, said digit portions including a plurality of finger portions and a thumb portion, each of said finger portions extending substantially upwardly away from said palm portion and said thumb portion extending generally laterally away from said palm portion, each of said finger portions having a pair of longitudinal straight sides, said pair of longitudinal straight sides of each finger portion being parallel, said planar face having a wrist portion, said wrist portion being coupled to and extending from said palm portion opposite said digit portions, said cleaning glove including a peripheral wall coupled to and extending from a peripheral edge of said planar face, said peripheral wall having a main portion and a taper portion, said taper portion extending between said main portion and said peripheral edge of said planar face, said main portion being perpendicular to said planar face, said cleaning glove having a bottom end being open wherein said cleaning glove is configured for receiving a hand into said cleaning glove through said bottom end; and an adhesive layer positioned on and covering said planar face wherein said cleaning glove is configured to have debris adhered to said planar face by said adhesive layer when said cleaning glove is pressed against and removed from a surface, said adhesive layer completely covering said planar face;

a cover, said cover being planar and removably positioned on and covering said adhesive layer; and a tab being coupled to and extending outwardly from said cover substantially perpendicular to said peripheral wall wherein said tab is configured to facilitate being grasped for removal of said cover to expose said adhesive layer, said tab extending from an edge of said cover wherein said tab is coplanar with said cover.

* * * * *